US010502170B2

(12) United States Patent
Thibault et al.

(10) Patent No.: US 10,502,170 B2
(45) Date of Patent: Dec. 10, 2019

(54) FUEL INJECTOR

(71) Applicant: DELPHI TECHNOLOGIES IP LIMITED, St. Michael (BB)

(72) Inventors: Thierry Thibault, Saint Ouen les Vignes (FR); Nicolas Rodier, Blois (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/770,394

(22) PCT Filed: Oct. 18, 2016

(86) PCT No.: PCT/EP2016/074983
§ 371 (c)(1),
(2) Date: Apr. 23, 2018

(87) PCT Pub. No.: WO2017/067930
PCT Pub. Date: Apr. 27, 2017

(65) Prior Publication Data

US 2018/0313316 A1 Nov. 1, 2018

(30) Foreign Application Priority Data

Oct. 23, 2015 (FR) ..... 15 60122

(51) Int. Cl.
*F02M 61/10* (2006.01)
*F02M 51/06* (2006.01)
(Continued)

(52) U.S. Cl.
CPC ..... *F02M 61/10* (2013.01); *F02M 51/066* (2013.01); *F02M 55/002* (2013.01);
(Continued)

(58) Field of Classification Search
CPC .... F02M 61/10; F02M 51/066; F02M 55/002; F02M 61/16; F02M 61/1873; F02M 2200/46; F02M 2200/50; F02M 2200/502
(Continued)

(56) References Cited

U.S. PATENT DOCUMENTS 4,306,680 A * 12/1981 Smith ..... F02M 59/466 239/585.1
5,265,804 A * 11/1993 Brunel ..... F02M 57/02 239/585.1
(Continued)

FOREIGN PATENT DOCUMENTS

| | | | |
|---|---|---|---|
| CN | 1693696 | A | 11/2005 |
| DE | 19815892 | A1 | 10/1998 |
| EP | 2458194 | A2 | 5/2012 |

*Primary Examiner* — Steven J Ganey
(74) *Attorney, Agent, or Firm* — Joshua M. Haines

(57) ABSTRACT

A mobile valve member designed to be arranged in the nozzle body of a fuel injector, extends along a main axis and includes a piston formed of a first male cylinder of effective diameter forming the top end of the mobile member and of a second cylinder provided with an internal cylindrical bore of the effective diameter and a shutoff member including a male cylindrical shaft of the effective diameter that fits slidingly in the internal bore, and of a member extending as far as a pointed end provided with a mobile seat and forming the bottom end of the mobile member. The mobile member is hydraulically balanced and the length between the top end and the bottom end thereof is variable as a result of the sliding of the cylindrical shaft in the internal bore of the piston.

8 Claims, 3 Drawing Sheets

(51) Int. Cl.
*F02M 55/00* (2006.01)
*F02M 61/16* (2006.01)
*F02M 61/18* (2006.01)

(52) U.S. Cl.
CPC ..... *F02M 61/16* (2013.01); *F02M 61/1873* (2013.01); *F02M 2200/46* (2013.01); *F02M 2200/50* (2013.01); *F02M 2200/502* (2013.01)

(58) Field of Classification Search
USPC ..... 239/88, 95, 96, 585.1, 585.5, 533.11, 239/533.12
See application file for complete search history.

(56) References Cited

U.S. PATENT DOCUMENTS

| | | | | |
|---|---|---|---|---|
| 5,617,998 | A * | 4/1997 | Buckley | F02M 59/365 239/95 |
| 6,681,999 | B1 | 1/2004 | Ruehle et al. | |
| 2005/0199846 | A1 | 9/2005 | Kim et al. | |
| 2011/0198419 | A1 | 8/2011 | Nagatomo | |

* cited by examiner

FUEL INJECTOR

CROSS REFERENCE TO RELATED APPLICATIONS

This application is a national stage application under 35 USC 371 of PCT Application No. PCT/EP2016/074983 having an international filing date of Oct. 18, 2016, which is designated in the United States and which claimed the benefit of FR Patent Application No. 1560122 filed on Oct. 23, 2015, the entire disclosures of each are hereby incorporated by reference in their entirety.

TECHNICAL DOMAIN

The present invention concerns a fuel injector, specifically one designed for a common-rail injection system, the injector being provided with a nozzle in which the needle is opened or closed directly by an electromagnetic coil actuator.

TECHNOLOGICAL BACKGROUND TO THE INVENTION

A fuel injector in the prior art comprises a coil actuator and a magnetic armature acting directly upon a valve member such as to open or close the fuel injection holes.

Such an injector requires a valve member that is hydraulically balanced or nearly hydraulically balanced, such that the relatively low force exerted by the solenoid actuator is enough to move said valve member.

SUMMARY OF THE INVENTION

The present invention is intended to overcome the drawbacks mentioned above by proposing a simple and cheap solution.

For this purpose, the invention proposes a mobile valve member that is designed to be arranged in the nozzle body of a fuel injector, the mobile member extending along a main axis between a top end and a bottom end that is provided with a mobile valve seat designed to cooperate with a static seat arranged on the inner face of the nozzle body about a circular line of the effective diameter. The mobile member is designed to slide between a closed position in which the two valve seats are in sealing contact about said circular line to prevent fuel injection, and an open position in which the two valve seats are separated from one another to enable said injection.

Furthermore, the mobile member advantageously comprises a piston formed by a first male cylinder with an effective diameter forming the top end of the mobile member and a second cylinder with a larger external diameter that has an internal cylindrical bore of effective diameter extending axially in the second cylinder as far as a back, and a shutoff member formed by a cylindrical body comprising a male cylindrical shaft with an effective diameter that fits slidingly with clearance in the internal bore of the piston, and a pointed male cylindrical member of diameter greater than the effective diameter, the pointed cylindrical member extended as far as a pointed end provided with a mobile valve seat and forming the bottom end of the mobile member.

Thus, advantageously, the mobile valve member is hydraulically balanced and the length between the top end and the bottom end thereof is variable as a result of the sliding of the cylindrical shaft in the internal bore of the piston.

The mobile member also has a first compressed spring between the piston and the shutoff member that permanently stresses the piston and the shutoff member to extend the mobile member.

The shutoff member also has a disk flange substantially arranged between the cylindrical shaft and the pointed cylinder, said flange extending radially from the cylindrical body of the shutoff member to a peripheral edge designed to fit slidingly against the inner face of the injector nozzle body. The flange has an upper face facing the piston and an opposing lower face facing the valve seat. Said flange also defines a first restricted orifice and a second restricted orifice, both of which extend between the opposing faces of the flange, enabling the pressurized fuel to flow at reduced speed from one side of the flange to the other, creating a pressure difference between the faces of the flange.

The piston also has a return channel extending from the back of the internal bore and opening out at the top end of the first cylinder.

The bore has a first section of greater diameter than the effective diameter and a second section with the effective diameter, such that the piston includes a circular end forming a sealing lip cooperating with a circular annular surface of the upper face of the flange. The first restricted orifice is arranged on the outside of said circular annular surface and the second restricted orifice is arranged on the inside of said circular annular surface.

The mobile member is limited in extension by anchoring means preventing the shutoff member from becoming detached from the piston, and in compression by the sealing lip butting sealingly against the upper face of the flange.

The invention also relates to an injection nozzle of a high-pressure fuel injector, the nozzle including a mobile valve member formed according to the preceding paragraphs.

The nozzle also has a nozzle body that is elongate along the main axis, the body having a cylindrical lateral peripheral wall that is tapered at one end, and an upper wall at the other end. The upper wall is provided with a pressurized fuel inlet orifice and an axial through-bore forming an annular guide of effective diameter, and the tapered end is formed on the inner face of the wall of the nozzle body of the static valve seat arranged close to the injection holes extending across the peripheral wall.

The mobile member is arranged axially to slide in the internal space of the nozzle body, the first cylinder of the piston fitting slidingly with clearance in the open annular guide, such that the mobile valve seat cooperates with the fixed valve seat and that the mobile assembly can slide along the main axis between the closed position and the open position in which the mobile seat is separated from the static seat.

The invention also covers a fuel injector including an actuator and a nozzle made as described above, the actuator being an electromagnet having a static coil and a mobile magnetic armature attached directly to the piston.

SHORT DESCRIPTION OF THE DRAWINGS

Other characteristics, objectives and advantages of the invention are set out in the detailed description below and in the attached drawings, given by way of non-limiting example, in which.

DESCRIPTION OF PREFERRED EMBODIMENTS

Figure 1:
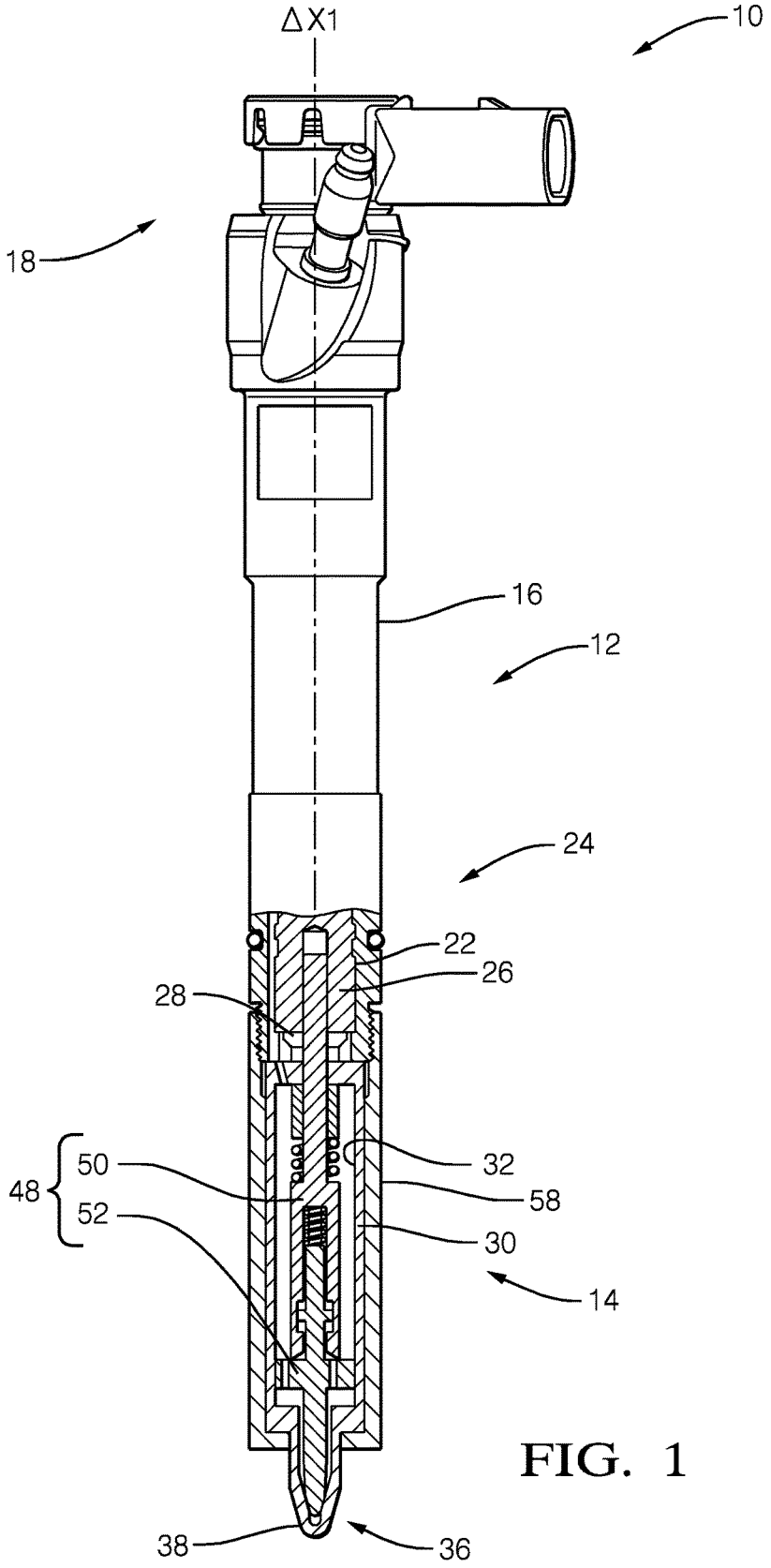
FIG. 1 is an overview of an injector according to the invention.

A fuel injector 10, as shown in FIG. 1, is described briefly to identify the main components. The injector 10 extends along a main axis X1 and includes an actuator assembly 12, shown at the top of the figure, and a nozzle assembly 14, shown below.

The actuator assembly 12 includes a substantially cylindrical body 16 extending from an injector head 18 to a lower transverse face 20 and, in a bore 22 provided for this purpose, the body 16 contains an electromagnet 24 including a static coil 26 in the body 16 and a movable magnetic armature 28 along the main axis X1.

The nozzle assembly 14 also includes a body 30 axially extending the actuator body 16, the peripheral wall 32 of which defines an internal space V. The nozzle body 30 extends axially in a cylindrical portion from an upper transverse face 34 in sealing surface contact with the lower face 20 of the injector body, to a portion of smaller section ending in a pointed end 36 provided with injection holes 38 extending through the peripheral wall 32 from an inlet located on the inner face 40 to an outlet located on the outer face 42. Furthermore, the nozzle body 30 includes a fuel inlet orifice 44, said orifice 44 being formed in the upper face 34 and, at the other end of the body 30, the inner face 40 of the peripheral wall is provided with a static valve seat 46 just above the inlets of the injection holes 38.

In the internal space V, a mobile valve member 48, also referred to professionally as a needle, is arranged to slide along the main axis X1. The mobile member 48 is telescopic and comprises principally a cylindrical piston 50 and a shutoff member 52 that are arranged slidingly in relation to one another. At one end, the piston 50 emerges through a bore 54 in the upper face 34 of the nozzle body, this portion emerging from the nozzle body being rigidly connected to the magnetic armature 28, and at an opposite end, on the side of the pointed end 36, the shutoff member is provided with a mobile valve seat 56 cooperating with the static seat 46. In operation, the mobile valve member 48 moves axially between a closed position PF in which the mobile valve seat 56 is in sealing contact against the static valve seat 46 about a circular line of the effective diameter DE, and an open position PO in which the two seats are separated from one another. In the pointed end of the nozzle body 30, beneath this circular line ("beneath" according to the orientation of the figure), the nozzle body 30 forms a small space known to the person skilled in the art as the sac S, into which the injection holes 38 open.

The actuator assembly 12 and the nozzle assembly 14 are rigidly connected to one another by an injector nut 58 that is threaded onto the nozzle body 30 to bear against an outer shoulder thereof, and is screwed tightly onto the actuator body 16.

The injector 10 also includes a high-pressure channel 60 extending into the actuator body 16 from an inlet just inside the lower face 20 to communicate with the fuel inlet orifice 44 in the nozzle body. The fuel F enters the internal space V of the nozzle body and occupies all of the available volume inside said space V.

The nozzle assembly 14 is described below in greater detail with reference to FIG. 2 et seq.

The piston 50 of the mobile valve member 48 is a cylindrical part with a first narrow cylinder 62 with an external diameter equal to the effective diameter DE arranged above (according to the arbitrary orientation of the figure) a second cylinder 64 of greater external diameter, the first and second cylinders 62, 64 being joined by a transverse shoulder 66. The person skilled in the art can easily understand that the dimensions and diameters described as being equal are equal in consideration of normal manufacturing tolerances and other operational clearances.

The second cylinder 64 of the piston has a bore 68 opening out in the lower face limiting the bottom end to a beveled annular surface forming a sealing lip 70. From this lip 70, the bore 68 extends axially into the second cylinder 64 in a first section 72 of diameter D72 greater than the effective diameter DE, then in a second section 74 of diameter equal to the effective diameter DE. The two sections of the bore 72, 74 are connected by an internal shoulder from which the second section 74 extends as far as a back face 76, from where a return channel 78 extends axially inside the first cylinder 72, before opening out in the emerging portion thereof, outside the nozzle body.

The shutoff member 52 of the mobile valve member 48 comprises three coaxial cylindrical portions, of which the central portion is a transverse disk flange 80, also referred to as a boost flange, the external diameter of which is such as to fit the inner face 40 of the body 30 slidingly. A cylindrical shaft 84 of diameter equal to the effective diameter DE extends from the center of the upper face 82 of the flange 80, said cylindrical shaft 84 extending first through the first section 72 of the bore of the piston and then engaging slidingly in the second section 74 of the bore of the piston. A pointed cylindrical shaft 88 of diameter D88 that is greater than the effective diameter DE extends from the center of the lower face 86 of the flange 80, the pointed end of said pointed cylindrical shaft 88 having the mobile valve seat 56 cooperating with the static valve seat 46 of the nozzle body 30.

The upper face 82 of the flange 80 has an annular sealing surface 90 cooperating with the sealing lip 70 of the piston as well as two restricted orifices passing through the flange 80 between the upper face 82 and the lower face 86 thereof. The first restricted orifice 94 is arranged on the outside of the annular sealing surface 90, i.e. between the annular surface 86 and the peripheral edge of the flange, while the second restricted orifice 96 is on the inside of the annular sealing surface 90.

As a result of the sliding fit of the flange 80 in the inner face of the wall of the nozzle body, the flange 80 separates the internal space V of the nozzle body into an upstream space V1 located above the flange 80, on the side of the upper face 82 and of the fuel inlet orifice 44 in the nozzle body, and a downstream space V2 located beneath the flange 80, on the side of the lower face 86 and of the injection holes 38 opening into the sac S. The restricted orifices 94, 96 thus create fluid communications between the upstream space V1 and the downstream space V2.

By engaging in the second section 74 of the bore, the cylindrical shaft 88 of diameter DE passes through the first section 72, which defines an annular chamber C1 into which the second restricted orifice 94 opens, establishing a fluid communication with the downstream space V2.

Furthermore, the face of the back 76 of the second bore of the piston and the end of the cylindrical shaft 84 define a return chamber C2 in which a spring 92 is compressed, said spring tending to push the two parts 50, 52 apart from one another and to lengthen the mobile valve member 48.

Anchoring means 98 are arranged in the annular chamber C1, said means being shown schematically in the figure as two annular protuberances engaging complementarily and limiting said lengthening of the mobile valve member 48.

The first cylinder 62 of the piston is guided axially inside the bore 54 of the upper face of the nozzle body. According to the alternative in FIG. 2, the diameter D54 of the bore 54 is slightly greater than the effective diameter DE of the piston, and an independent annular guide 100 fitted about the first cylinder 62 ensures the seal. The internal diameter of the annular guide 100 is equal to the effective diameter DE and is kept pressed against the nozzle body 30 by a second spring 102 compressed between the annular guide 100 and the shoulder 66 of the piston. The second spring 102 thus permanently stresses the piston downwards in the figure and presses the annular guide 100 against the top of the nozzle body. The face of the guide 100 in contact with the nozzle body 30 is beveled and forms another sealing lip. In the figures, the diameters and clearances are shown with exaggerated differences.

Figure 4:
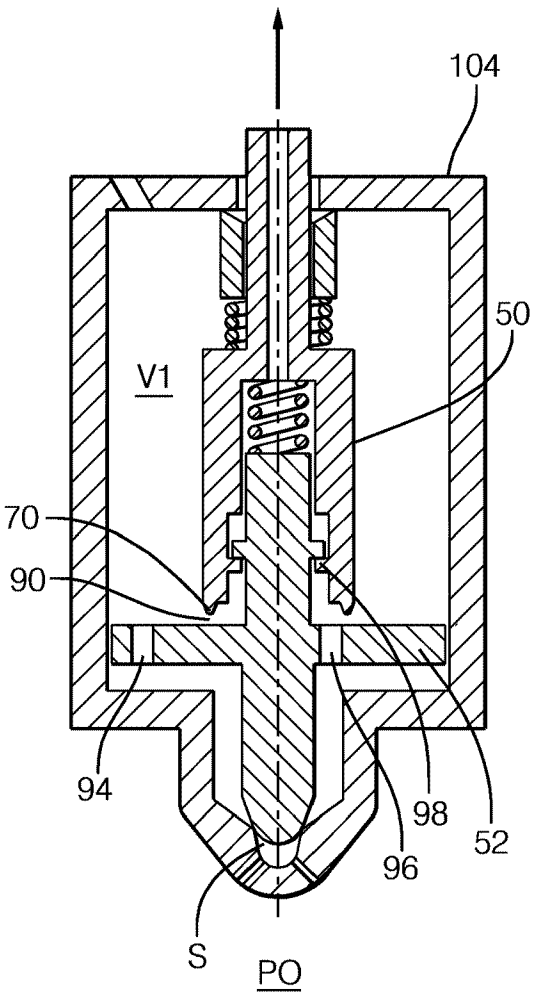

According to the alternative in FIG. 4, the annular guide 100 is built into an upper guide 104 including the upper transverse face 34 of the nozzle body, said face including the fuel inlet orifice 44 from the center of which the annular guide 100 extends. Said upper guide 104 is held in place compressed between the nozzle body 30 and the actuator body 16 by the injector nut 58. Said other spring 102 is then compressed between the upper guide 104 and the shoulder 66 of the piston.

In operation, the first cylinder 62 of the piston is caused to slide in the annular guide 100 and the cylindrical shaft 84 is caused to slide in the second section 74 of the bore in the piston. The person skilled in the art understands that these sliding adjustments between male and female cylinders requires an operational clearance J of several microns, despite it being specified herein that all of the male and female cylinders have a diameter equal to the effective diameter DE, said diameter being the nominal diameter.

Operation of the injector 10 is described succinctly below with reference to FIGS. 2 to 5.

The injector 10 is arranged inside a common-rail fuel injection device feeding pressurized fuel to several injectors. Pressurized fuel F therefore enters via the inlet of the injector and, in a modern diesel injection device, the diesel fuel may reach a pressure of 2000 or 3000 bars. To illustrate this operation, the pressure of the fuel entering the injector has been set arbitrarily at 2500 bars.

The fuel F enters the nozzle body 30 and occupies all of the available internal space V.

Figure 2:
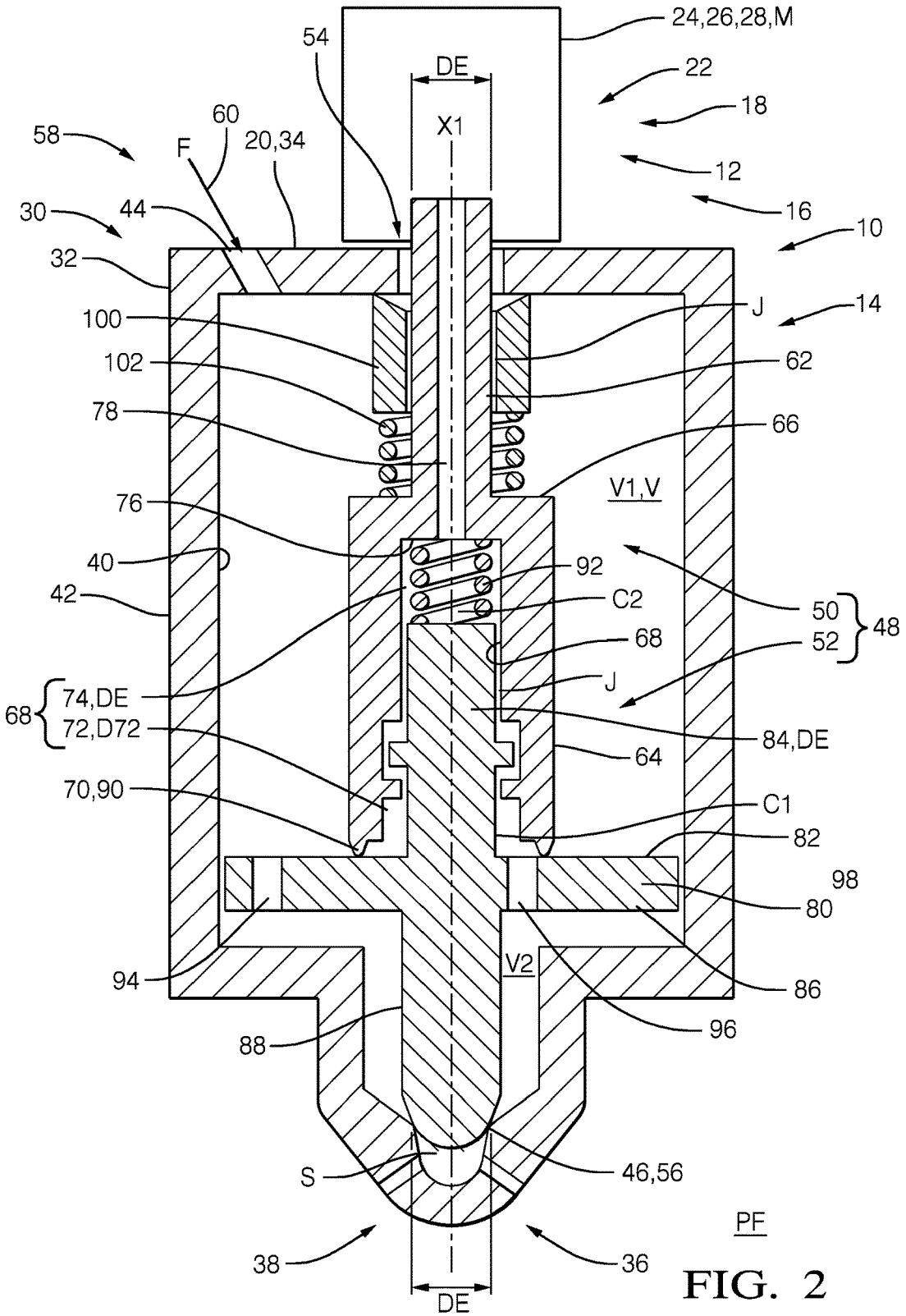
FIG. 2 is a diagram of the nozzle of the injector in FIG. 1.
Figure 3:
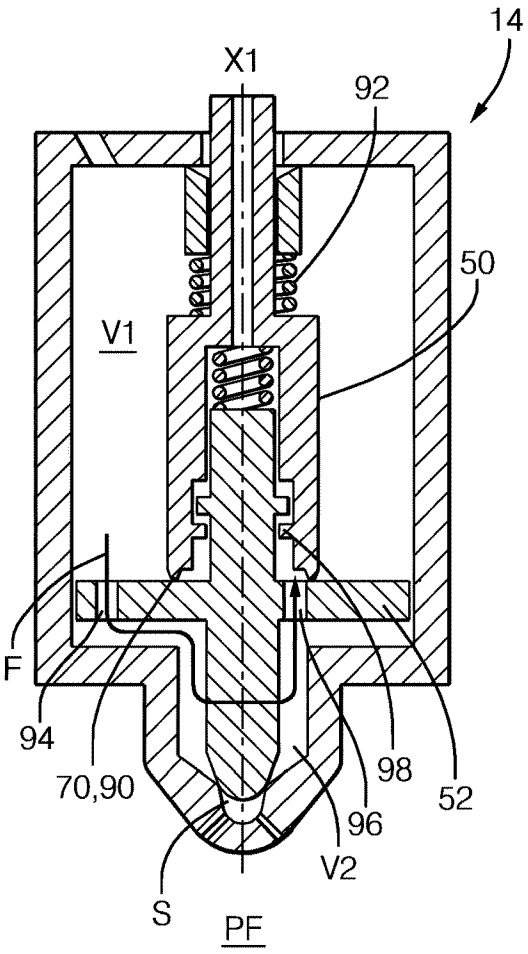

In a first phase and as shown in FIG. 2 or 3, the electromagnet 24 is not powered, the second spring 102 pushes the piston 50 back towards the shutoff member 52 and the shutoff member 52 is itself pushed back by the first spring 92 to the closed position PF, i.e. where the sealing lip 70 of the piston is in sealing contact against the annular surface 90 arranged on the upper face of the flange, and the mobile valve seat 56 is in sealing contact against the static seat 46 about the circular line of the effective diameter DE. The sac S is isolated from the volume V2. Consequently, the annular chamber C1 is only in communication with the downstream space V2 via the second restricted orifice 96.

The fuel F that has entered the upstream space V1 via the inlet orifice 44 flows into the downstream space V2 via the first restricted orifice 94, before returning to the annular chamber C1 via the second restricted orifice 96. The flow of the fuel F through the restricted orifices enables the three spaces V1, V2, C1 to be filled with fuel F at high pressure. There may be a slight pressure difference between these three spaces. In the closing phase, if the pressure in the upstream space V1 is 2500 bars, the pressure in the downstream space V2 may be just 2200 bars and the pressure in the sac S 2100 bars. The pressure in the annular chamber C1 is substantially equal to the pressure in the downstream space V2, and there is no particular pressure in the return chamber C2 since same is in permanent communication with the low pressure.

During this closed phase of the valve seat, minor static leaks of fuel F occur via the operational clearances J allowed firstly between the cylindrical shaft 84 and the second section 74 of the bore in the piston, this leak occurring at low pressure via the return chamber C2 and the return channel 78, and secondly between the first cylinder 62 of the piston and the annular guide 100, this leak also occurring at low pressure to return to a return circuit leading to a low-pressure tank (not shown).

The person skilled in the art can also see that the piston 50 is hydraulically balanced. Effectively, the aggregate surface area of the faces generating a downward force on the piston is equal to the aggregate surface area of the faces generating an upward force on the piston. Thus, the forces generated by the pressure being applied to the faces of the piston 50 are balanced, said faces belonging to the first cylinder of effective diameter DE and the second bore also of effective diameter DE, regardless of the shape or profile of said faces.

The same is true of the shutoff member 52, in which the pressurized faces lie between the cylindrical shaft of effective diameter DE and the valve seat also of effective diameter DE.

In a second phase illustrated in FIG. 4, the electromagnet 24 starts being powered, the magnetic armature 28 is attracted by the magnetic field M generated by the coil 26 and the piston 50 starts to move upwards, driven by the magnetic armature. The second spring 102 is compressed while the first spring 92 is stretched, the forces of the two springs partially offsetting one another, and the electromagnet 24 then only has to overcome the difference between the forces of the springs. The first spring 92 holds the shutoff member 52 in the closed position PF while the anchoring means 98 of the piston 50 and of the shutoff member 52 are just actuated so that the mobile member 48 cannot be further lengthened.

Once the sealing lip 70 has been lifted away from the annular sealing surface 90, the annular chamber C1 is in fluid communication with the upstream space V1, and pressurized fuel F can flow from the upstream space V1 to the downstream space V2 via the two restricted orifices 94, 96, which helps to balance the pressures in the upstream space V1 and the downstream space V2.

Figure 5:
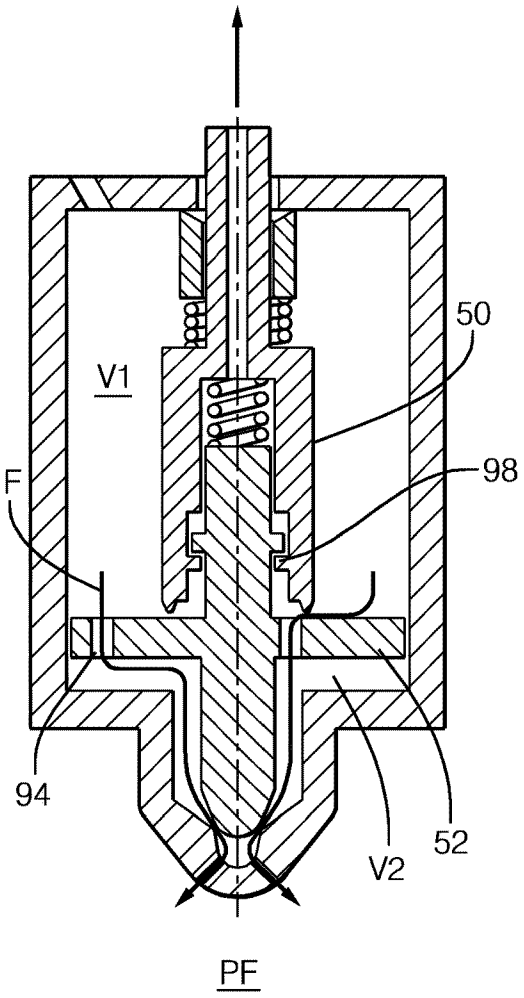
FIGS. 3, 4 and 5 are identical to FIG. 2 and show different operating phases of the injector nozzle.

In a third phase illustrated in FIG. 5, the electrical power supply to the electromagnet 24 is maintained and the piston 50 continues to move upwards. Once the anchoring means 98 have been actuated, the piston 50 drives the shutoff member 52 such that the valve seat 46, 56 opens and enables the pressurized fuel F to be injected via the injection holes 38. The pressure in the sac S then increases and supplements the opening force of the shutoff member 52. The flow rate of the fuel F passing through the first and second restricted orifices 94, 96 creates a slight pressure difference, the pressure in the upstream space V1 being slightly greater than the pressure in the downstream space V2 such as to generate a force opposing the opening force of the pressure in the sac S. The shutoff member 52 thus remains hydraulically balanced and the electromagnet need only provide a small force to continue opening the shutoff member.

In the opening phase, if the pressure in the upstream space V1 remains at 2500 bars, the pressure in the downstream space V2 is approximately 2400 bars and the pressure in the sac S is approximately 2300 bars. The pressure in the annular chamber C1 is equal to the pressure in the upstream space V1, and there is no particular pressure in the return chamber C2 since same is in permanent communication with the low pressure.

The length of the first spring 92 does not vary since the anchoring means 98 are actuated from the second phase detailed above, and the electromagnet 24 only has to overcome the compression force of the second spring 102.

In a fourth closing phase, the power supply to the electromagnet is interrupted and the piston 50, under the influence of the second spring 102, moves back down to butt sealingly against the upper face of the flange. The pressurized fuel F can no longer flow from the upstream space V1 to the downstream space V2, except via the first restricted orifice 94.

Injection continues and, since the pressurized fuel F can no longer flow from the upstream space V1 to the downstream space V2 except via the first restricted orifice 94, a significant pressure difference is created, the upstream pressure being greater. This pressure difference moves the shutoff member 52 towards the closed position PF of the valve seat and stops injection.

During this closing phase, if the pressure in the upstream space V1 is 2500 bars, the pressure in the downstream space V2 may be just 2200 bars and the pressure in the sac S 2100 bars. The pressure in the annular chamber C1 is substantially equal to the pressure in the downstream space V2, and there is no particular pressure in the return chamber C2 since same is in permanent communication with the low pressure.

Conclusive tests and simulations have been carried out on injectors in which the effective diameter is 1.5 mm, the sum of the forces of the springs is slightly greater than 40 N such that the valve seat is sealed in the closed position under a pressure of 250 bars to offset a pressure in the combustion chamber, notably at the end of combustion. The electromagnet needs to be able to deliver a force of around 65 N over a path of approximately 250 μm.

LIST OF REFERENCES USED

X1 main axis
V internal space of the nozzle body
M magnetic field
F fuel
PF closed position
PO open position
DE effective diameter
D72 diameter of the first bore section
D88 diameter of the pointed shaft
V1 upstream space
V2 downstream space
C1 annular chamber
C2 return chamber
J operational clearance
S sac
10 injector
12 actuator assembly
14 nozzle assembly
16 actuator body
18 injector head
20 lower transverse face of the actuator body
22 coil bore
24 electromagnet
26 coil
28 magnetic armature
30 nozzle body
32 peripheral wall of nozzle body
34 upper transverse face of the nozzle body
36 pointed end
38 injection holes
40 inner face of the peripheral wall
42 outer face of the peripheral wall
44 fuel inlet orifice in the nozzle body
46 static valve seat
48 mobile valve member
50 piston
52 shutoff member
54 bore of the upper face of the nozzle body
56 mobile valve seat
58 injector nut
60 high-pressure channel
62 first cylinder of the piston
64 second cylinder of the piston
66 outer shoulder of the piston
68 bore of the piston
70 sealing lip
72 first section of the bore in the piston
74 second section of the bore in the piston
76 back face of the second section
78 return channel
80 flange
82 upper face of the flange
84 cylindrical shaft
86 lower face of the flange
88 pointed cylinder
90 annular sealing surface
92 first spring
94 first restricted orifice
96 second restricted orifice
98 anchoring means
100 annular guide
102 second spring
104 upper guide

The invention claimed is:

1. A mobile valve member that is designed to be arranged in a nozzle body of a fuel injector, the mobile valve member extending along a main axis between a top end and a bottom end that is provided with a mobile valve seat designed to cooperate with a static seat arranged on an inner face of the nozzle body about a circular line of an effective diameter, the mobile valve member being designed to slide between a closed position in which the mobile valve seat and the static seat are in sealing contact about the circular line to prevent fuel injection, and an open position in which the mobile valve seat and the static seat are separated from one another to enable fuel injection, the mobile valve member comprising:

a piston made up of a first male cylinder of the effective diameter forming the top end of the mobile member and a second cylinder with an external diameter that is greater than the effective diameter, the second cylinder provided with an internal cylindrical bore having the effective diameter extending axially in the second cylinder as far as a back face; and a shutoff member made up of a cylindrical body comprising a male cylindrical shaft having the effective diameter that fits slidingly with a clearance in the internal cylindrical bore of the piston, and a male pointed cylindrical member with a diameter that is greater than the effective diameter, the male pointed cylindrical member extending as far as a pointed end including the mobile valve seat and forming the bottom end of the mobile valve member;

wherein the mobile valve member is hydraulically balanced and a length between the top end and the bottom end thereof is variable as a result of a sliding of the male cylindrical shaft in the internal cylindrical bore of the piston.

2. A mobile valve member as claimed in claim 1, also including a first spring compressed between the piston and the shutoff member that permanently stresses the piston and the shutoff member to extend the mobile valve member.

3. A mobile valve member as claimed in one of claim 1, wherein the shutoff member also has a disk flange arranged between the male cylindrical shaft and the male pointed cylindrical member, the disk flange extending radially from the cylindrical body of the shutoff member to a peripheral edge which fits slidingly against the inner face of the nozzle body, the disk flange having an upper face facing the piston and an opposing lower face facing the static seat, the disk flange also defining a first restricted orifice and a second restricted orifice, both of which extend between the upper face of the disk flange and the opposing lower face of the disk flange, enabling pressurized fuel to flow at reduced speed from one side to the other of the disk flange, creating a pressure difference between the upper face of the disk flange and the opposing lower face of the disk flange.

4. A mobile valve member as claimed in claim 3, in which the internal cylindrical bore has a first section of greater diameter than the effective diameter and a second section having the effective diameter, such that the piston includes a circular end forming a sealing lip cooperating with a circular annular surface of the upper face of the disk flange, the first restricted orifice being arranged on an outside of the circular annular surface and the second restricted orifice being arranged on an inside of said circular annular surface.

5. A mobile valve member as claimed in claim 4, wherein the mobile valve member is limited in extension by an anchoring means preventing the shutoff member from becoming detached from the piston, and in compression by the sealing lip butting sealingly against the upper face of the disk flange.

6. A mobile valve member as claimed in claim 1, wherein the piston also has a return channel extending from the back face of the internal cylindrical bore and opening out at the top end of the first male cylinder.

7. An injection nozzle of a high-pressure fuel injector, the injection nozzle comprising:

a nozzle body that is elongate along a main axis and that has a cylindrical lateral peripheral wall that is tapered at one end, and an upper wall at the other end, the upper wall having a pressurized fuel inlet orifice and an axial through-bore forming an annular guide such that the axial through-bore has an effective diameter, the tapered end being formed on an inner face of the cylindrical lateral peripheral wall of the nozzle body of a static seat arranged close to injection holes extending across the cylindrical lateral peripheral wall; and a mobile valve member extending along the main axis between a top end and a bottom end that is provided with a mobile valve seat designed to cooperate with the static seat of the nozzle body about a circular line of the effective diameter, the mobile valve member being designed to slide between a closed position in which the mobile valve seat and the static seat are in sealing contact about the circular line to prevent fuel injection, and an open position in which the mobile valve seat and the static seat are separated from one another to enable fuel injection, the mobile valve member comprising:

a piston made up of a first male cylinder of the effective diameter forming the top end of the mobile member and a second cylinder with an external diameter that is greater than the effective diameter, the second cylinder provided with an internal cylindrical bore having the effective diameter extending axially in the second cylinder as far as a back face; and a shutoff member made up of a cylindrical body comprising a male cylindrical shaft having the effective diameter that fits slidingly with a clearance in the internal cylindrical bore of the piston, and a male pointed cylindrical member with a diameter that is greater than the effective diameter, the male pointed cylindrical member extending as far as a pointed end including the mobile valve seat and forming the bottom end of the mobile valve member;

wherein the mobile valve member is hydraulically balanced and a length between the top end and the bottom end thereof is variable as a result of a sliding of the male cylindrical shaft in the internal cylindrical bore of the piston; and wherein the mobile valve member is arranged axially to slide in an internal space of the nozzle body, the first male cylinder of the piston fitting slidingly with a clearance in the annular guide, such that the mobile valve seat cooperates with the static seat and that the mobile valve member slides along the main axis between the closed position and the open position in which the mobile valve seat is separated from the static seat.

8. A fuel injector comprising:

an actuator; and an injection nozzle comprising:

a nozzle body that is elongate along a main axis and that has a cylindrical lateral peripheral wall that is tapered at one end, and an upper wall at the other end, the upper wall having a pressurized fuel inlet orifice and an axial through-bore forming an annular guide such that the axial through-bore has an effective diameter, the tapered end being formed on an inner face of the cylindrical lateral peripheral wall of the nozzle body of a static seat arranged close to injection holes extending across the cylindrical lateral peripheral wall; and a mobile valve member extending along the main axis between a top end and a bottom end that is provided with a mobile valve seat designed to cooperate with the static seat of the nozzle body about a circular line of the effective diameter, the mobile valve member being designed to slide between a closed position in which the mobile valve seat and the static seat are in sealing contact about the circular line to prevent fuel injection, and an open position in which the mobile valve seat and the static seat are separated from one another to enable fuel injection, the mobile valve member comprising:

a piston made up of a first male cylinder of the effective diameter forming the top end of the mobile member and a second cylinder with an external diameter that is greater than the effective diameter, the second cylinder provided with an internal cylindrical bore having the effective diameter extending axially in the second cylinder as far as a back face; and a shutoff member made up of a cylindrical body comprising a male cylindrical shaft having the effective diameter that fits slidingly with a clearance in the internal cylindrical bore of the piston, and a male pointed cylindrical member with a diameter that is greater than the effective diameter, the male pointed cylindrical member extending as far as a pointed end including the mobile valve seat and forming the bottom end of the mobile valve member;

wherein the mobile valve member is hydraulically balanced and a length between the top end and the bottom end thereof is variable as a result of a sliding of the male cylindrical shaft in the internal cylindrical bore of the piston;

wherein the mobile valve member is arranged axially to slide in an internal space of the nozzle body, the first male cylinder of the piston fitting slidingly with a clearance in the annular guide, such that the mobile valve seat cooperates with the static seat and that the mobile valve member slides along the main axis between the closed position and the open position in which the mobile valve seat is separated from the static seat; and wherein the actuator is an electromagnet including a static coil and a mobile magnetic armature attached directly to the piston.

* * * * *